United States Patent [19]

Faltin

[11] 4,230,311

[45] Oct. 28, 1980

[54] STORAGE PALLET ARRANGEMENTS FOR FOLDED PAPER ITEMS

[76] Inventor: Hans G. Faltin, 4135 Wilshire Dr., York, Pa. 17402

[21] Appl. No.: 5,879

[22] Filed: Jan. 23, 1979

[51] Int. Cl.[3] ..... B65H 5/22

[52] U.S. Cl. ..... 271/3.1; 271/145; 271/216

[58] Field of Search ..... 271/3.1, 145, 201, 207, 271/216, 212

[56] References Cited

U.S. PATENT DOCUMENTS

| | | | |
|---|---|---|---|
| 2,683,601 | 7/1954 | Camerano | 271/216 |
| 4,000,806 | 1/1977 | Dietrich | 198/443 |
| 4,062,537 | 12/1977 | Dietrich | 271/201 |
| 4,136,863 | 1/1979 | Sloan | 271/212 |

FOREIGN PATENT DOCUMENTS

| | | | |
|---|---|---|---|
| 243690 | 12/1963 | Austria | 271/9 |

*Primary Examiner*—Richard A. Schacher
*Attorney, Agent, or Firm*—Laurence R. Brown

[57] ABSTRACT

A simple circular panel pallet has stored thereon a helical array of folded paper items and is rotated in opposite directions about its axis to respectively load and unload the items. By unloading a helical stack of items from the top, high-speed, low-friction operation permits attaining on stream unloading at press speeds of 60,000 units per hour. A tape is fed under the layer of shingled items in the helical array for access in unloading to guide the folded edge of the paper items into removal nips.

9 Claims, 7 Drawing Figures

STORAGE PALLET ARRANGEMENTS FOR FOLDED PAPER ITEMS

TECHNICAL FIELD

This invention relates to storage of folded paper items and particularly to pre-printed newspaper inserts which are held to insert on line into newspapers as they flow in a stream off a high speed press. In more particularity this invention relates to storing stacks of printed inserts on pallets or skids in a sequence that can be removed at high speeds for insertion on line into newspapers and to the associated methods and apparatus for loading and unloading such pallets.

BACKGROUND ART

There has been developed in the art machinery for storing printed newspaper items or inserts on pallets in a spiral array or stack. Representative of such machinery are Felix Dietrich U.S. Pat. Nos. 4,000,806 issued Jan. 4, 1977 and 4,062,537 issued Dec. 13, 1977. In these patents the items are stacked in a spiral sequence around the center post of a pallet assembly which center post serves as a conveyance member that engages a trolley assembly for transport. As outlined in the former patent, the items are stacked in a spiral stack and then destacked from the bottom of the stack by a complex feeding mechanism.

Among the problems with this prior art are the two significant disadvantages (1) that the pallet structure is expensive and complex and (2) that the weight of the stack must be encountered in feeding off the bottom and thus it is not easy to get high speed performance as necessary to feed inserts directly from the stack into on-line newspaper streams having speeds of about 60,000 items per hour. Other problems include stack stability in transit, storage space requirements and lack of flexibility in stacking heights which limits utility of a given pallet design to a narrow range of paper sheet thicknesses and sizes.

Among the objects of this invention is the general objective to correct the aforesaid deficiencies of the prior art by providing improved paper item stacking apparatus and methods.

More specific objects of the invention includes the provision of simple, low-cost, universal pallet structures easy to transport and efficient to stack and process.

One object of the invention is to increase processing speeds at which stored newspaper inserts may be taken from storage and fed into newspaper streams.

Another object of the invention is to provide positive feed means for removing the stored paper items from a stack at speeds compatible with on line feeding into newspaper streams produced by high speed presses in the order of 60,000 pieces per hour.

Other objects, features and advantages of the invention will be found throughout the following description.

DISCLOSURE OF INVENTION

A simplified pallet consisting of a planar surface, preferably circular in shape, has stacked thereupon in a spiral array a multiplicity of folded paper items overlapped in a shingled sequence that can be unloaded for inserting on line into a newspaper stream from high speed presses at a speed as high as 60,000 items per hour. The pallet is rotated in one direction to stack the items and they are fed off the top by rotating the pallet in the opposite direction. A string fed into the spiral stack being underneath each single layer of shingled items permits the uppermost items to be lifted off the stack for insertion into nips removing them at high speeds in a substantially frictionless unloading in either shingled sequence or individual mode. Simplified loading and unloading apparatus rotates the pallets in opposite directions respectively to make the folded paper items available for top of the stack unloading fold edge leading.

PREFERRED EMBODIMENT OF INVENTION

Figure 1:
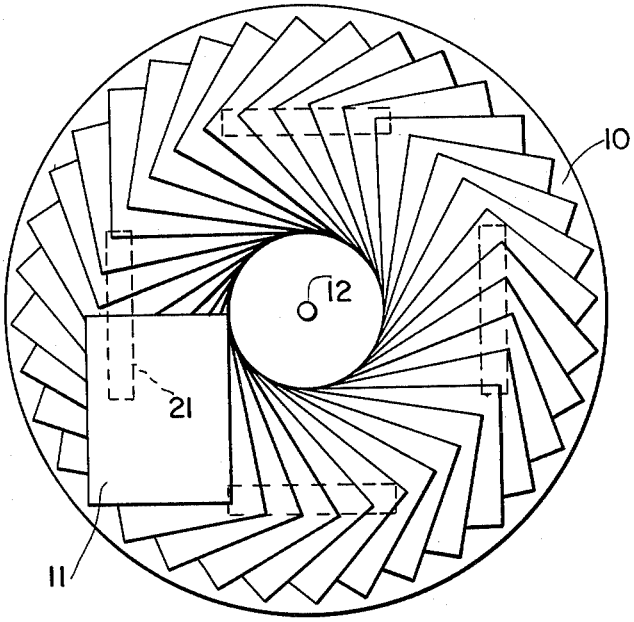
FIG. 1 is a top view of a loaded pallet showing shingled folded paper items in a helical array upon a planar circular pallet surface devoid of other structure.

The pallet or skid provided by this invention is simply a circular panel 10, as seen in FIG. 1, which serves as the bottom support member for a helical array of folded paper items 11 such as newspaper inserts, signatures or even unprinted jackets or folders. The items 11 are stacked symmetrically about a center pallet axis 12 so that the skid may be rotated about that axis as a center of gravity to load or unload the paper items.

Figure 2:
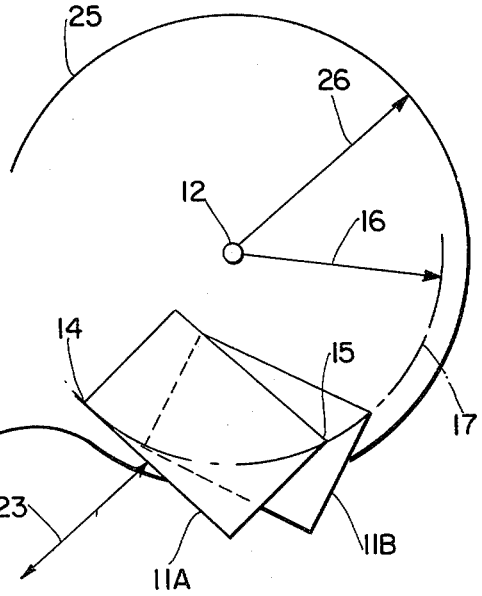
FIG. 2 is a top segmental view of the shingled folded paper items showing their stacking angles and the accompanying spiral string fed under each single layer to aid in unloading the items from the top of the stack.
Figure 3:
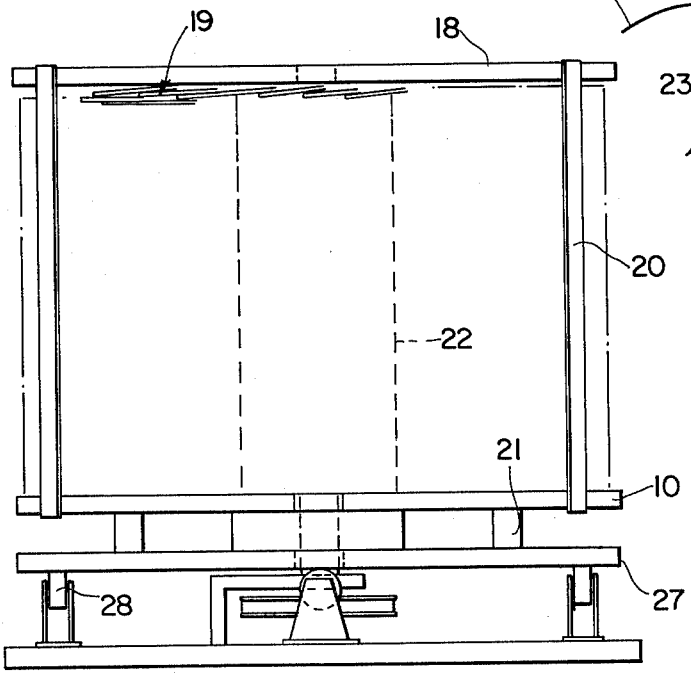
FIG. 3 is an elevation view of a loaded pallet having transport bindings holding the stack in place as positioned for unloading by rotation upon a lazy daizy type rig.

The sketch of FIG. 2 shows that the successive paper products 11A and 11B are shingled in a sequence and lie at such an angle that opposite corners 14, 15 lie on a circumferential cylinder defined at the radius 16 and identified by phantom line 17. When stacked in this manner the uppermost layer will be substantially planar without droop so that a top planar support member 18 as seen in FIG. 3 can rest on a stack 19 of the stored paper items.

Thus, the stack of paper items has stability so that they stay in place without a tendency to slide or slip out of the stack, and more important, so that stacks can be stored on top of each other where desired. Note in this respect that the lower support member has no rods or other members interfering with any desired height of the stack that is planned or results from thinner or thicker paper items of a given count. Also for transport the upper member 18 may be clamped to the lower support member 10 by straps 20 or the like. The legs 21 place the support platform member 10 far enough above a support surface floor so that a transport truck may lift and move the pallet.

In any event it is noted that the helical array extends upwardly in a stack around a cylindrical central column 22 devoid of structural members so that the stacked paper items are supported only by the horizontally disposed upwardly facing planar surface of the pallet panel 10, unless the top retainer member 18 is held in place for transport purposes. This is not necessary for temporary storage at a location near use, but vibration of a long trucking haul could displace the paper items and thus the preferably transport array includes the top and support members 18, 20.

As will be seen from FIG. 2 and hereinafter the paper items are fed on or off a rotating pallet support member in a straight line path designated by arrow 23. Thus in loading the items arrive at the location on the rotating pallet shown by item 11A to be shingled over the preceding item rotated into position 11B by the pallet. The corners 14 and 15 then are aligned on the cylindrical plane 17.

For purposes to be explained hereinafter, a string or tape 25 is disposed under each item 11A, 11B in the stack and thus assumes a helical pattern around the radius 26, having a free access end 25A which can be used to lift the uppermost item 11A into position to feed into a nip removal roller or the like.

As seen in FIG. 3, the pallet 10 may be set upon lazy daisy rotating platform 27 resting upon casters 28. This permits rotation in either direction for respectively loading or unloading the items from stack 19.

Figure 4:
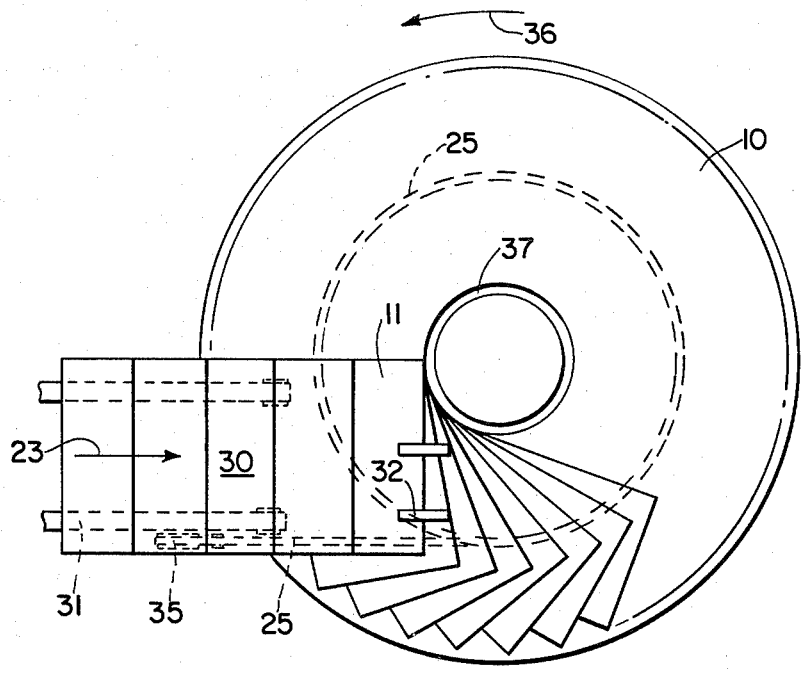
FIGS. 4 and 5 are respectively top and side partial views of a pallet being loaded.
Figure 5:
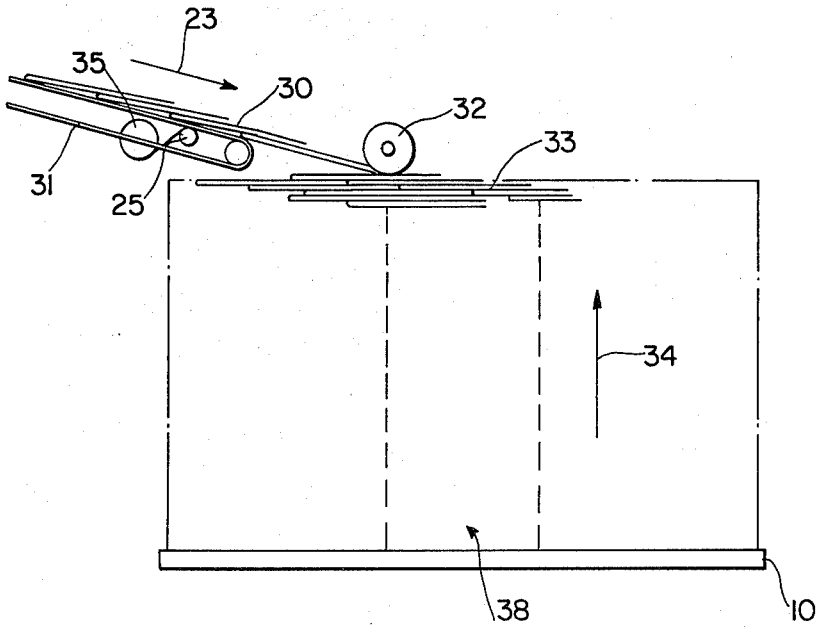

In the loading mode depicted by FIGS. 4 and 5 a shingled stream 30 of paper items is moved by conveyor belts 31 into a roller array 32 riding upon a pallet surface 10 or a partly stacked pile 33 of items building up in the direction of arrow 34. The string 25 is fed under the stream of items 30 from reel 35. The roller mechanism may be similar to that shown in the above-mentioned U.S. Pat. No. 4,062,537. The items are stacked from the lowermost end of the shingled helical array upwardly in a storage stack as the pallet and stacked items thereon rotate counterclockwise, as shown by arrow 36. If desired a stop such as a cylinder 37 could be used to limit travel of the items 11 thereby defining the central core 38 of the stack. However this is not necessary, and the items stack continuously in proper place by synchronization of the turning speeds of the pallet as effected by roller 32 and the feed speed of the stream 30 as supplied by belt conveyor 31.

Figure 6:
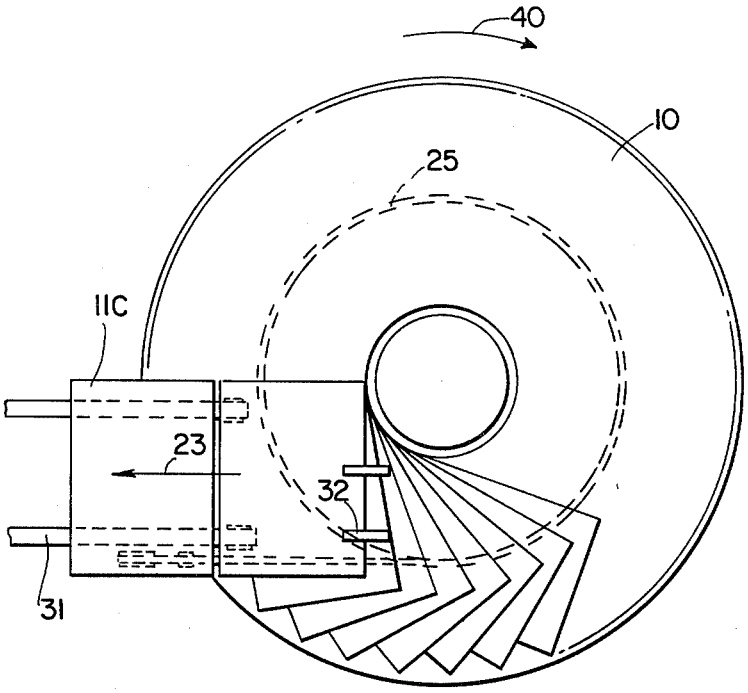
FIGS. 6 and 7 are respectively top and side partial views of a pallet being unloaded.
Figure 7:
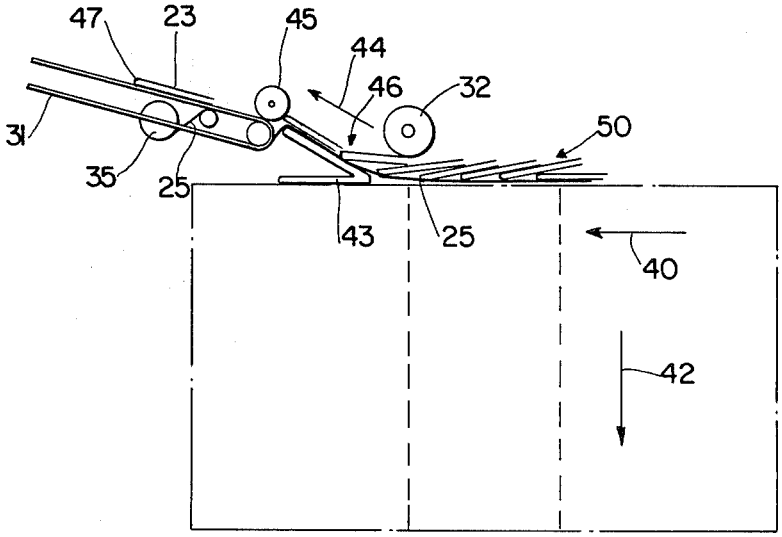

The unloading mode is depicted in FIGS. 6 and 7 as the pallet 10 is rotated in the opposite clockwise direction 40 by reversal of rollers 32 and conveyor belt 31.

It is seen from FIG. 7 that the stack is depleted downwardly 42 as the items are fed from the uppermost end of the helical array of stacked items upwardly on ramp 43 and in direction 44 into nip roller 45. The conveyor belt 31 may be driven at a high enough speed to separate individually the items 11C or conversely may keep them in a shingled array.

It may be seen that the string 25 under the shingled stream 46 serves to raise the leading fold edge 47 presented for removal by rotation of the pallet in the clockwise direction 40 so that the stream 46 passes over ramp 43 into the nip roller 45. This is particularly helpful in starting the removal process and when thinner paper items, such as two page items made from a single sheet folded over, are being processed that might otherwise tend to crumble and jam when fed off.

It is seen that the folded paper items being processed have been loaded from bottom up with open ends 50 forward and are unloaded from the top of the stack with fold 47 forward. This eliminates friction as required if unloading from the bottom of the stack with the weight of other stacked items bearing downwardly thereupon and permits the attainment of higher unloading speeds. Also it permits handling the storage of paper items on simple flat planar pallets without any complications or mechanisms required. The only friction essentially remaining is the sliding of a single paper item overlapped open ends over the fold of the next preceding item as it is removed from the top of the helical stack.

INDUSTRIAL APPLICABILITY

A low cost palletizing method for stacking and storing folded paper items on a simple panel pallet permits rotation of the pallet in one direction to stack the items in a helical array and reversal of the direction of rotation to feed the items off from the top of the stack.

The items are stacked in a stable palletized stack array that can be transported by lift trucks or the like and can be stored on top one another.

Thus, signatures or newspaper inserts may be preprinted and held until desired for on stream insertion in high speed press runs at speeds of 60,000 per hour, for example.

I claim:

1. A storage pallet assembly holding a plurality of folded paper items of at least two pages with a fold and open ends, comprising in combination, a bottom support member presenting only a horizontally disposed planar surface facing upwardly to receive said items in a stacked relationship thereupon and having a central vertical axis about which the items may be symmetrically disposed in a helical shingled array with the center of gravity along said axis so that the support member may be rotated for loading and unloading a stack of said items, and a stack of items in a shingled helical array on said support member symmetrically arrayed in a helix about said axis unsupported by any other member than said planar surface and having the open ends forward toward the lowermost end of the helical array and with fold trailing toward the upper end of the helical array and with each subsequent member being shingled upon the next preceding item with open ends overlapping the fold of the preceding item so that the topmost item has an accessible folded edge directed toward the uppermost end of the helical array for grasping to remove the shingled items individually or in shingled sequence from the top of the helical array where they are not weighted down by other items and thus can be unloaded faster with less inertia from said simplified storage pallet, wherein a tape member is wound helically under each one of the stored items stacked on said pallet, thereby providing means accessible from the top of the stack of items for lifting a leading edge of each item during removal from the stack.

2. A pallet assembly as defined in claim 1 wherein the bottom support member is circular in form with the items concentrically stacked about its center and adapted to rotate about its center with the stacked items in place and having a center of gravity along the axis stack intersecting the center of the circular support member.

3. A pallet assembly as defined in claim 1 wherein the bottom support member has legs extending it above a support surface to permit entry of a movable truck member thereunder for lifting and transporting the pallet.

4. A pallet assembly as defined in claim 1 including a top support member resting upon the stacked items and clamping members holding the top and bottom support members together so that the stack of items can be moved in transport without disturbing the spiral stacking relationship.

5. A pallet assembly as defined in claim 1 including means rotating the support member about its central axis for loading and unloading the stacked items, and means located at a fixed position relative to the outer periphery of the helical stack for processing the items in loading and unloading operations.

6. A pallet assembly as defined in claim 1 wherein the bottom support member consists of a flat panel member free of any members extending upwardly through the stack of items, thereby leaving the top of the stack at any desired stack height in a substantially horizontal plane for receiving a planar member thereupon adjacent the uppermost printed items in the stack.

7. A pallet assembly as defined in claim 1 wherein each item is rectangular in shape and is arrayed on said stack on the bottom support member so that diametrically opposite corners of each item lay substantially on a circumferential cylinder concentric with the axis of the stack and support member at a predetermined radial distance from the axis, thereby to afford a stack which has its top layer substantially in a plane normal to said axis.

8. A pallet assembly as defined in claim 1 in combination with means for rotating the bottom support member in one direction to load said items from the support member upwardly in one direction and to unload in the opposite direction said items from the top of the stack downwardly.

9. A pallet assembly combination as defined in claim 8 including means removing a continuously moving sequence of items from the top of said stack fold forward while synchronously rotating the bottom support member.

* * * * *